US010071492B2

(12) United States Patent
Abe

(10) Patent No.: US 10,071,492 B2
(45) Date of Patent: Sep. 11, 2018

(54) CUTTING APPARATUS AND NON-TRANSITORY COMPUTER READABLE STORING MEDIUM

(71) Applicant: BROTHER KOGYO KABUSHIKI KAISHA, Nagoya-shi, Aichi-ken (JP)

(72) Inventor: Daisuke Abe, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 337 days.

(21) Appl. No.: 14/813,844

(22) Filed: Jul. 30, 2015

(65) Prior Publication Data

US 2016/0031109 A1 Feb. 4, 2016

(30) Foreign Application Priority Data

Jul. 31, 2014 (JP) ..... 2014-155915

(51) Int. Cl.
*B26D 5/00* (2006.01)
*B26D 5/06* (2006.01)
*B26F 1/38* (2006.01)

(52) U.S. Cl.
CPC ..... *B26D 5/005* (2013.01); *B26D 5/06* (2013.01); *B26F 1/3813* (2013.01); *B26D 2005/002* (2013.01)

(58) Field of Classification Search
CPC ..... B25D 5/005; B25D 5/06; B26F 1/3813; B26D 2005/002
USPC ..... 83/72, 75, 76.1, 76.6
See application file for complete search history.

(56) References Cited

U.S. PATENT DOCUMENTS 5,353,355 A * 10/1994 Takagi ..... B26D 5/00 382/111
2002/0092389 A1* 7/2002 Feldman ..... B26D 5/00 83/49
2005/0186010 A1* 8/2005 Shibata ..... B26D 7/015 400/621
2010/0175521 A1* 7/2010 Dubesset ..... B26D 5/005 83/13
2013/0255458 A1* 10/2013 Kawase ..... B26D 5/005 83/76.1
2013/0340580 A1* 12/2013 Strong ..... B26D 5/007 83/13
2014/0000429 A1* 1/2014 Fujihara ..... B26D 5/00 83/76.6
2014/0170935 A1* 6/2014 Maurer ..... B24C 3/04 451/8

(Continued)

FOREIGN PATENT DOCUMENTS

JP H05-154790 A 6/1993

*Primary Examiner* — Omar Flores Sanchez
(74) *Attorney, Agent, or Firm* — K&L Gates LLP

(57) ABSTRACT

A cutting apparatus includes a cut mechanism configured to cut a workpiece; and a control device configured to: judge whether or not each of plural patterns to be cut by the cut mechanism is a test pattern used for evaluating a cut quality of the workpiece cut by the cut mechanism; determine a cut sequence, the cut sequence indicating a sequence in which the plural patterns are cut from the workpiece by the cut mechanism, the cut sequence being determined so that a pattern judged as the test pattern is cut before a normal pattern judged to not be the test pattern; and control the cut mechanism to cut the plural patterns from the workpiece according to the cut sequence.

9 Claims, 15 Drawing Sheets

(56) References Cited

U.S. PATENT DOCUMENTS

2014/0290459 A1* 10/2014 Hasegawa ..... B26D 5/06
83/575
2016/0026168 A1* 1/2016 Crystal ..... B26D 5/005
700/114

* cited by examiner

600

PATTERN DATA

| PATTERN NUMBER | COORDINATE DATA | TEST PATTERN FLAG α | PATTERN SHAPE |
|---|---|---|---|
| P001 | COORDINATE DATA(x1,y1) ... | 0 | 220 |
| P002 | COORDINATE DATA(x1',y1') ... | 0 | 250 |
| T002 | COORDINATE DATA(x1'',y1'') ... | 1 | 230 |
| T004 | COORDINATE DATA(x1''',y1''') ... | 1 | 240 |

FIG.10

650

SELECTION SEQUENCE DATA

| SELECTION SEQUENCE i | PATTERN NUMBER | CENTRAL COORDINATE | PATTERN SHAPE |
|---|---|---|---|
| 1 | P001 | COORDINATE DATA(p1,q1) | |
| 2 | T002 | COORDINATE DATA(p2,q2) | |
| 3 | T004 | COORDINATE DATA(p3,q3) | |
| 4 | P002 | COORDINATE DATA(p4,q4) | |

FIG.11

700

| CUT DATA | | |
|---|---|---|
| PROCESSING SEQUENCE j | DATA STRUCTURE | PATTERN SHAPE |
| 1 | COORDINATE DATA(s1'',t1'')<br>⋮ | △ |
| 2 | COORDINATE DATA(s1''',t1''')<br>⋮ | ○ |
| 3 | CUT STOP DATA | |
| 4 | COORDINATE DATA(s1,t1)<br>⋮ | |
| 5 | COORDINATE DATA(s1',t1')<br>⋮ | |
| 6 | CUT STOP DATA | |

FIG.12

CUTTING APPARATUS AND NON-TRANSITORY COMPUTER READABLE STORING MEDIUM

CROSS-REFERENCE TO RELATED APPLICATION

This application is based upon and claims the benefit of priority from the prior Japanese Patent Application 2014-155915, filed on, Jul. 31, 2014, the entire contents of which are incorporated herein by reference.

FIELD

The disclosure relates to a cutting apparatus and a non-transitory computer readable storing medium.

BACKGROUND

A cutter plotter provided with a test cut mode is known in which the user is allowed to evaluate whether or not cutting conditions such as the pressure applied by the blade or the movement speed of the blade with respect to the workpiece is properly specified.

In such types of cutter plotters provided with the test cut mode, the user is to input cutting conditions to the cutter plotter which the user believes to be appropriate after selecting the test cut mode. Responsively, the cutter plotter executes the test cut with the cut conditions specified by the user. After completing the test cut, the user is to evaluate the cut quality of the test cut. The user is allowed to readily find the appropriate cut condition from the result of the test cuts performed by the cutter plotter under the conditions specified by the user.

In the above described cutter plotter, the user is required to initially select the test cut mode and switch the operating mode to the normal cut mode after the cutter plotter has completed the test cut of the workpiece when the test cut and the normal cut are executed consecutively. The mode switch required to enable the consecutive execution of the test cut and the normal cut was cumbersome for the user.

SUMMARY

Aspects described herein provide a cutting apparatus and a non-transitory computer readable storing medium capable of executing the test cut and the normal cut without requiring mode switching.

According to aspects of the disclosure, a cutting apparatus includes a cut mechanism configured to cut a workpiece; and a control device configured to: judge whether or not each of plural patterns to be cut by the cut mechanism is a test pattern used for evaluating a cut quality of the workpiece cut by the cut mechanism; determine a cut sequence, the cut sequence indicating a sequence in which the plural patterns are cut from the workpiece by the cut mechanism, the cut sequence being determined so that a pattern judged as the test pattern is cut before a normal pattern judged to not be the test pattern; and control the cut mechanism to cut the plural patterns from the workpiece according to the cut sequence.

This summary is not intended to identify critical or essential features of the disclosure, but instead merely summarizes certain features and variations thereof. Other details and features will be described in the sections that follow.

BRIEF DESCRIPTION OF THE DRAWINGS

Aspects of the disclosure are illustrated by way of example, and not by limitation, in the accompanying figures in which like reference characters may indicate similar elements.

FIG. 10 illustrates pattern data 600.

FIG. 11 illustrates selection sequence data 650.

FIG. 12 illustrates cut data 700.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments will be described with reference to the accompanying drawings.

[Structure of Cutting Apparatus 1]

Figure 1:
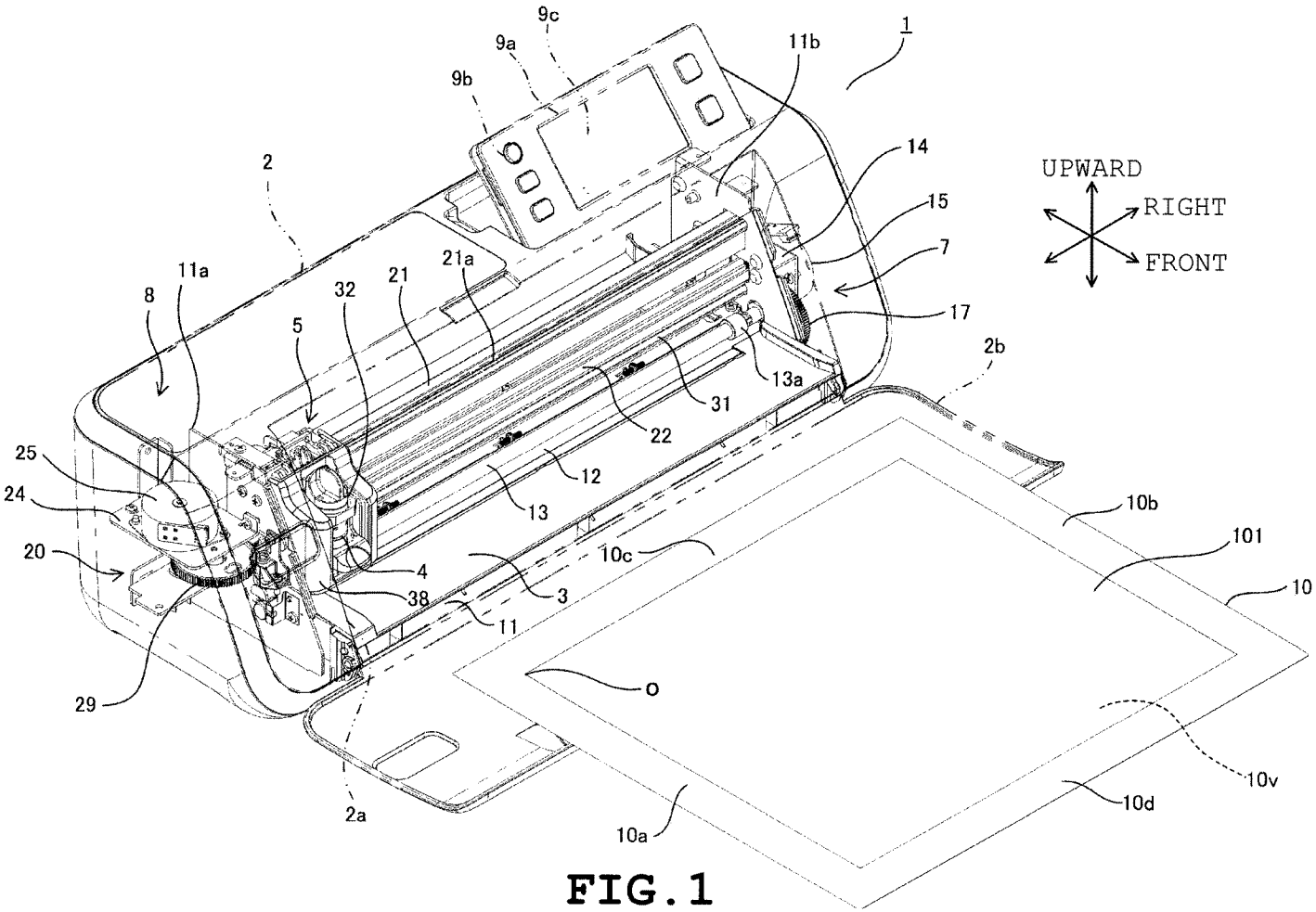
FIG. 1 is a perspective view illustrating the internal structure of a cutting apparatus 1 with a body 2 of the cutting apparatus 1.

Referring to FIG. 1, a description will be given on the structure of the cutting apparatus 1 of the present embodiment. The cutting apparatus 1 is configured to cut a workpiece 101. The cutting apparatus 1 is provided with a body 2, a platen 3, a machine frame 11, a cut head 5, a feed mechanism 7, a transfer mechanism 8, a display 9*a*, and switches 9*b*. The workpiece 101 is placed on a holding sheet 10 configured to be set on the platen 3. The cut head 5, the feed mechanism 7, and the transfer mechanism 8 serve as a cutter mechanism configured to cut the workpiece 101 placed on the holding sheet 10.

The feed mechanism 7 is configured to feed the holding sheet 10 set on the platen 3 in a predetermined feed direction. The transfer mechanism 8 transfers the cut head 5 in a direction crossing the direction in which the holding sheet 10 is fed. For example, the cut head 5 may be transferred in a direction orthogonal to the direction in which the holding sheet 10 is fed. In the present embodiment, forward and rearward direction in which the feed mechanism 7 is fed is defined as the Y direction. The left and right direction in which the transfer mechanism 8 is transferred is defined as the X direction. The up and down direction orthogonal to the front and rear direction and the left and right direction is defined as the Z direction. The feed mechanism 7 and the transfer mechanism 8 serve as a transfer unit 20 configured to relatively transfer the holding sheet 10 holding the workpiece 101 and the cut head 5 in the X and Y directions.

The body 2 is shaped like a laterally elongate rectangular box. A front opening 2*a* is formed into the front face of the body 2. A front cover 2*b* configured to open and close the front opening 2*a* is provided at the front face of the body 2. The holding sheet 10 holding the workpiece 101 is set on the platen 3 by the user with the front opening 2*a* opened. A later described cartridge 4 may be detachably attached to a cartridge holder 32 of the cut head 5 by the user.

The machine frame 11 is attached to the body 2. The machine frame 11 is provided with sidewalls 11*a* and 11*b*. The sidewalls 11*a* and 11*b* are located on the left and right sides of the platen 3.

The display 9*a* is provided on the right side portion of the upper surface of the body 2. The display 9*a* is a liquid crystal color display capable of displaying in full color. Switches 9*b* allowing user operation are provided around the display 9*a*. A touch panel 9*c* is provided on the surface of the display 9*a*. The display 9*a* presents information pertaining to pattern cutting such as images of various patterns and messages, etc. that need to be informed to the user. The user is allowed to select a pattern from the choice of patterns presented on the display 9*a*, make selections of various processing modes, set various parameters, and make various inputs by operating the switches 9*b* and the touch panel 9*c*.

When the workpiece 101 is being cut by the cutting apparatus 1, the platen 3 is located under the holding sheet 10. The upper surface portion of the platen 3 includes a horizontal surface. The holding sheet 10 holding the workpiece 101 is fed over the platen 3.

The holding sheet is made of a synthetic resin material for example and is shaped like a rectangular sheet. The holding sheet 10 is configured to hold the workpiece 101. An adhesive layer 10*v* is formed on area of the upper surface of the holding sheet 10 surrounded by edge portions 10*a*, 10*b*, 10*c*, and 10*d*. The adhesive layer 10*v* is formed for example by applying an adhesive coating on the holding sheet 10. The holding sheet 10 is configured to hold the workpiece 101 by allowing the workpiece 101 to stick on the adhesive layer 10*v*. The adhesive force of the adhesive layer 10*v* is controlled to a level that reliably holds the workpiece 101 unremovably during the cutting operation by a cutting blade 6 of the cartridge 4 while allowing the workpiece 101 to peel relatively easily after the cutting operation has been completed. The size of the workpiece 101 is substantially the same as the size of the region in which the adhesive layer 10*v* is formed. The size of the region which may be cut by the cutting apparatus 1 is substantially the same as the size of the workpiece 101. Further, examples of workpiece 101 include materials such as paper and cloth.

[Explanation of Feed Mechanism 7]

The feed mechanism 7 is explained in detail hereinafter with reference to FIG. 1. The feed mechanism 7 is provided with a drive roller 12, a pinch roller 13, a mount frame 14, a Y-axis motor 15, a drive gear, and a follower gear 17.

The drive roller 12 and the pinch roller 13 are disposed between the left and right sidewalls 11*a* and 11*b*. The drive roller 12 and the pinch roller 13 extend in the left and right direction. The pinch roller 13 and the drive roller 12 are disposed one over the other in the up and down direction. In this example, the pinch roller 13 is disposed above the drive roller 12.

The left and right end sides of the drive roller 12 are supported rotatably by the sidewalls 11*a* and 11*b*. A follower gear 17 is provided on the right end of the drive roller 12. The mount frame 14 is attached to the outer surface side of the right side wall 11*b*. The Y-axis motor 15 is mounted on the mount frame 14. The Y-axis motor 15 comprises, for instance, a stepper motor. The follower gear 17 is engaged with the drive gear 16. The diameter of the drive gear 16 is less than the diameter of the follower gear 17. The drive gear 16 is provided on the output shaft of the Y-axis motor 15. The rotational drive force of the Y-axis motor 15 is transmitted to the drive roller 12 via the drive gear 16 and the follower gear 17 by the rotation of the Y-axis motor 15 to cause the rotation of the drive roller 12.

The left and right end sides of the pinch roller 13 are supported rotatably by the sidewalls 11*a* and 11*b*. The sidewalls 11*a* and 11*b* support the pinch roller 13 so as to be slightly movable in the up and down direction, i.e. the thickness-wise direction of the workpiece 101. The pinch roller 13 is provided with a roller portion 13*a*. The roller portion 13*a* is disposed on each side of the shaft of the pinch roller 13. The diameter of the shaft of the roller portion 13*a* is greater than the diameter of the shaft of the pinch roller 13.

Thus, left and right edge portions 10*a* and 10*b* of the holding sheet 10 are held between the drive roller 12 and the roller portions 13*a* of the pinch roller 13. The feed mechanism 7 feeds the holding sheet 10 in the front and rear direction by the rotation of the drive roller 12 driven by the Y-axis motor 15 with the edge portions 10*a* and 10*b* of the holding sheet 10 held between the drive roller 12 and the roller portions 13*a*.

[Explanation of Transfer Mechanism 8]

Figure 2:
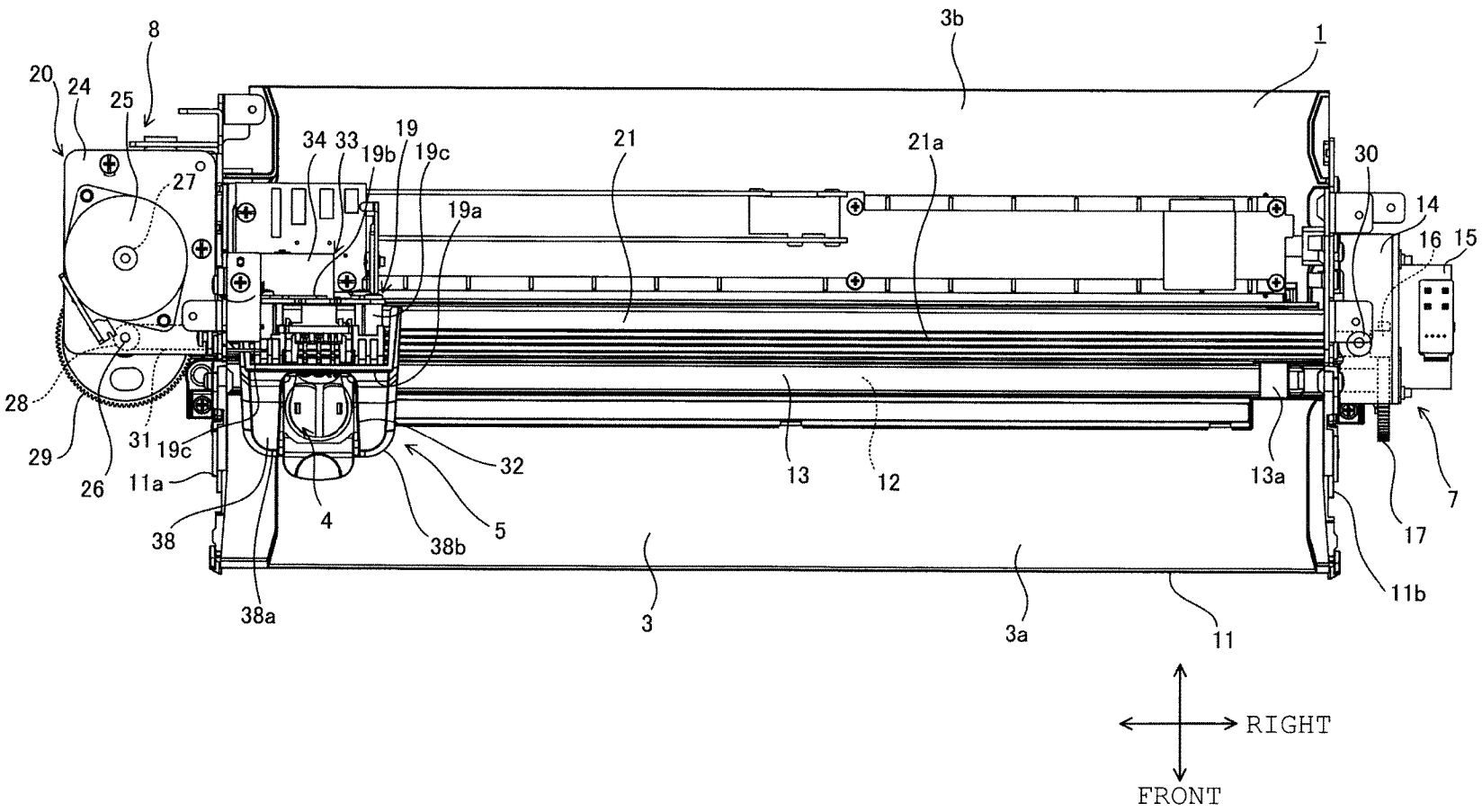
FIG. 2 is a plan view illustrating the internal structure of the cutting apparatus 1

The transfer mechanism 8 is explained in detail hereinafter with reference to FIG. 2. The transfer mechanism 8 transfers the cut head 5 in the left and right direction crossing the direction in which the holding sheet 10 is fed. The transfer mechanism 8 is provided with components such as a carriage 19, guide shafts 21 and 22, a mount plate 24, an X-axis motor 25, a pulley shaft 26, a drive gear 27, a left-side timing pulley 28, a follower gear 29, a right-side timing pulley 30, and a timing belt 31.

The guide shafts 21 and 22 extend in the left and right direction and are disposed between the left and right sidewalls 11*a* and 11*b* so as to be located behind the pinch roller 13. A guide groove 21*a* is provided on the upper surface portion of the guide shaft 21 and on the lower surface portion of the guide shaft 22 so as to extend from the left end to the right end of each of the guide shafts 21 and 22. The carriage 19 is provided with a pair of protrusions provided one on the upper side portion and one on the lower portion. The protrusions are configured to engage with the guide grooves 21*a* from the upper side and the underside. The carriage 19 is supported slidably in the left and right direction by the guide shafts 21 and 22 through the engagement of the protrusions and the guide grooves 21*a*.

A mount plate 24 is attached to the outer surface side of the left sidewall 11*a*. A mount frame 24 is attached to the outer surface side of the right sidewall 11*b*. A pulley shaft 26 is provided rotatably in the front side of the X-axis motor 25. The pulley shaft 26 extends in the up and down direction. The drive gear 27 is fixed to the output shaft of the X-axis motor 25. The pulley shaft 26 rotatably supports the left-side timing pulley 28 and the follower gear 29. The timing pulley 28 and the follower gear 29 are structurally integral and thus, rotate as one. The follower gear 29 meshes with the drive gear 27.

The right-side timing pulley 30 is rotatably mounted on the mount frame 14. The right-side timing pulley 30 and the left-side timing pulley 28 are wound with an endless timing belt 31 which extends horizontally along the left and right direction. The intermediate portion of the timing belt 31 is connected to a rear surface portion of the carriage 19.

When the X-axis motor 25 is rotated, the rotational drive of the X-axis motor 25 is transmitted to the timing belt 31 via the drive gear 27, the follower gear 29, and the left-side timing pulley 28 to cause the carriage 19 to be moved in the left and right direction. As later described in detail, the carriage 19 is provided with the cut head 5. Thus, the movement of the carriage 19 in the left and right direction results in the movement of the cut head 5 in the left and right direction.

[Explanation of Cut Head 5]

The cut head 5 is explained with reference to FIGS. 2 and 3. The cut head 5 is provided with a cartridge holder 32 and an up-down drive mechanism 33 which are disposed in the front and rear direction with respect to the carriage 19. The up-down drive mechanism 33 drives the cartridge holder 32 as well as the cartridge 4 in the up and down direction (Z direction).

The carriage 19 is provided with a front wall 19*a*, a rear wall 19*b*, upper arm 19*c*, and a lower arm 19*d*. The upper and lower arms 19*c* and 19*d* connect the front and rear walls 19*a* and 19*b*. The carriage 19 is shaped so as to surround the front and rear sides as well as the upper and lower sides of the guide shafts 21 and 22. A forwardly oriented Z-axis motor 34 is attached to the rear wall 19*b* of the carriage 19. A transmission mechanism is provided between the Z-axis motor 34 and the cartridge holder 32. The transmission mechanism is configured to decelerate the rotary motion of the Z-axis motor 34 and convert the rotary motion to the up and down movement of the cartridge holder 32. The transmission mechanism and the Z-axis motor 34 serve as the up-down drive mechanism 33.

When the Z-axis motor 34 is driven in the forward and reverse directions, the rotary motion is converted into the up and down movement via the transmission mechanism to cause the cartridge holder 32 as well as the cartridge 4 to be moved in the lifted position or the lowered position. As a result, the cartridge 4 held by the cartridge holder 32 is moved between the lowered position for cutting the workpiece 101 using the cutting blade 6 and the lifted position (indicated by a double-dot chain line in FIG. 3) in which the blade tip 6*a* of the cutting blade 6 is spaced apart from the workpiece 101 by a predetermined distance.

In attaching the cartridge 4 to the cartridge holder 32, the blade tip 6*a* contacts the workpiece 101 when the cartridge holder 32 is in the lowered position. The pressure exerted on the cutting blade 6*a* during the cutting operation, hereinafter referred to as the cutting pressure, is controlled to an appropriate pressure suitable for performing the cutting operation based on the amount of rotation of the Z-axis motor 34.

The cartridge holder 32 is provided with a holder frame 35, an upper holder 36, and a lower holder 37. The holder frame 35 is driven up and down by the up-down drive mechanism 33. The upper holder 36 and the lower holder 37 are secured to the holder frame 35. More specifically, the front wall 19*a* of the carriage 19 is provided with a cover member 38 configured to cover the left and right sides of the carriage 19 from the front side. The holder frame 35, serving as a movable portion, is provided between the right side projection 38*a* and the left side projection 38*b* of the cover member 38. The upper and lower surface as well as the front surface of the holder frame 35 are opened. The upper holder 36 and the lower holder 37 are shaped like a frame and are installed into the holder frame 35. The cartridge 4 is inserted through the upper holder 36 and the lower holder 37 from the upper side to be attached to the holder frame 35.

A lever member 40 is provided between the upper holder 36 and the lower holder 37. The lever member 40 is provided with a pair of left arm 41 and a right arm 42 and an operating portion 43 provided so as to connect the tips of the arms 41 and 42. The lever member 40 is supported swingably by the holder frame 35 with the upper end sides of the arms 41 and 42 serving as the base end. Engagement portions 41*a* and 42*a* shaped like small cylinders are provided on the inner surface sides of the arms 41 and 42, respectively. The engagement portions 41*a* and 42*a* are configured to be capable of engagement with later described engagement subject portion 54*a* provided at the carriage 4.

Figure 3:
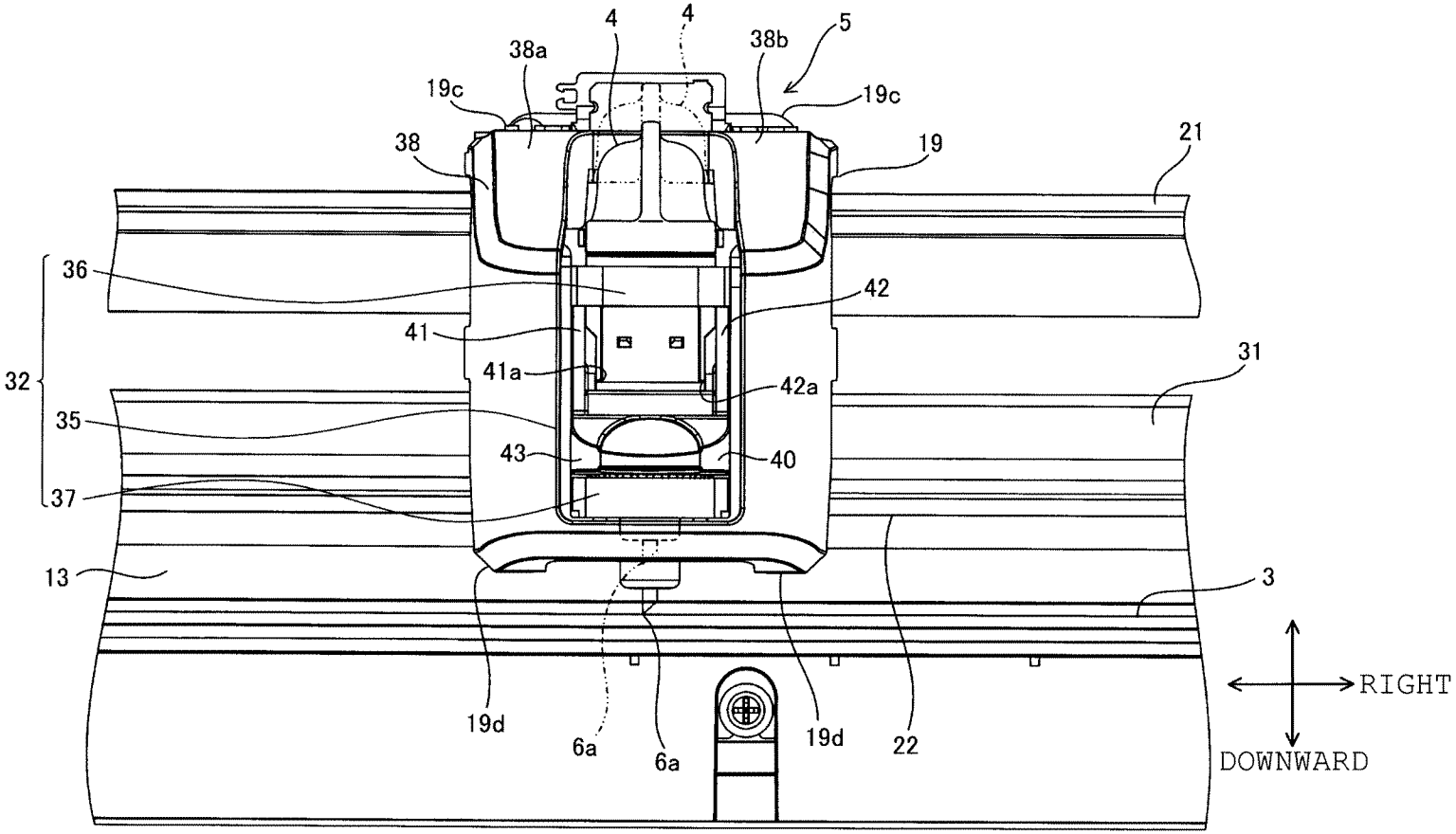
FIG. 3 is a front view illustrating the vicinity of a cut head 5.

The lever member 40 is configured to swing about the base ends of the arms 41 and 42 so as to be switchable between a locked position illustrated in FIG. 3 and an unlocked position. The lever member may be switched from the locked position to the unlocked position by pulling the operating portion 43 forward as viewed in FIG. 3. The cartridge 4 is secured to the lower holder 37 by the engagement of the engagement portions 41*a* and 42*a* with the engagement subject portion 54*a* of the cartridge 4 when the lever member 40 is in the locked position. In contrast, the lever member 40 is unlocked when the user pulls the operating portion 43 forward so as to be swung from the locked position to the unlocked position, thereby causing the engagement portions 41*a* and 42*a* to be spaced apart from the engagement subject portion 54*a*. The user is thus, allowed to readily and reliably cause attachment and detachment of the cartridge using the lever member 40.

[Explanation of Cartridge 4]

Figure 4:
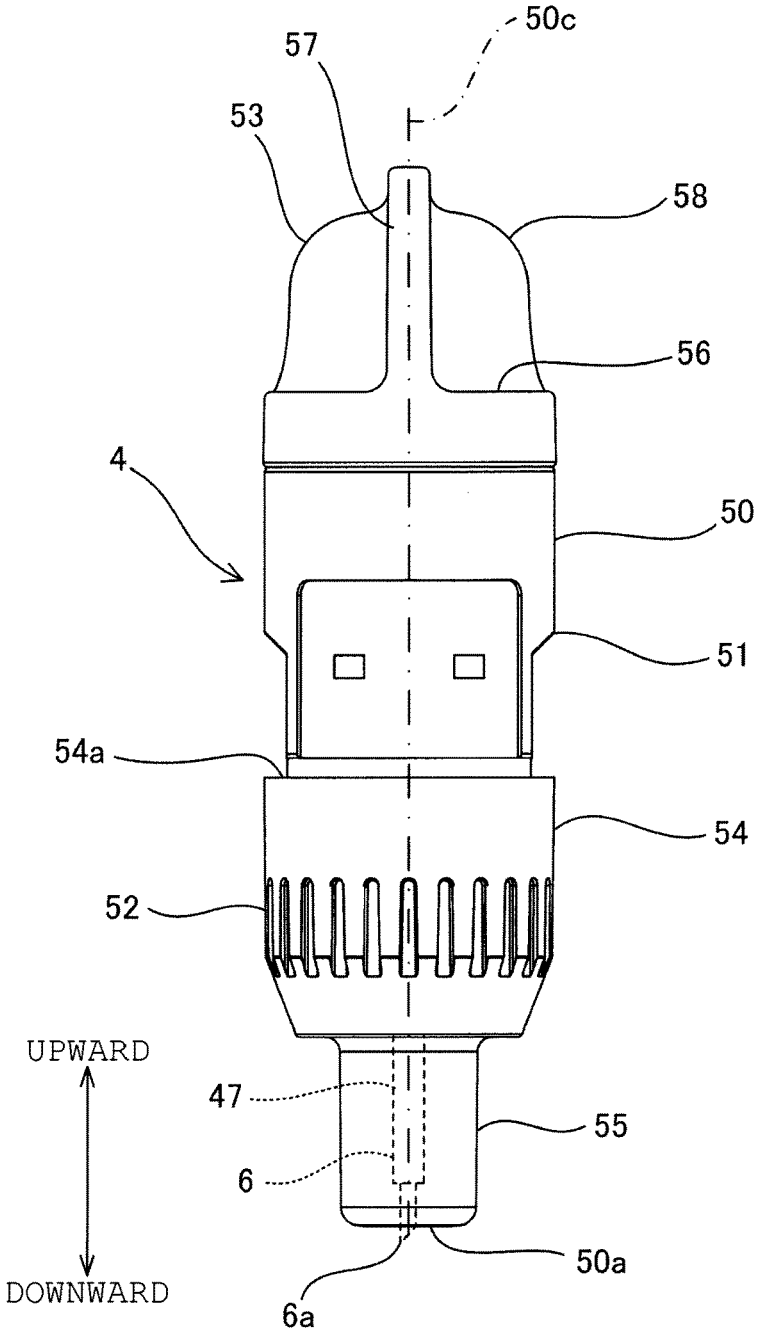
FIG. 4 is a front view of a cartridge 4.

The cutting apparatus 1 is provided with multiple cartridges 4 equipped with blades 6 suitable for the types of workpiece to be cut. The user may replace the cutting blade 6 provided to each cartridge 4. A description is given hereinafter on the cartridge 4 with reference to FIG. 4.

The cartridge 4 comprises an outer case 50. The outer case is provided with a case body 51, a cap portion 52 provided on one end of the case body 51, and a grip portion 53 provided on the other end of the case body 51. The case body 51 is shaped like a cylinder extending in the up and down direction. The cap portion 52 is provided with a large-diameter portion 54 being fitted into the lower end portion of the case body 51 and a small-diameter portion 55. Thus, the cap portion 52 is shaped like a stepped cylinder having an enclosed bottom. The engagement subject portion 54*a* is located on the upper end of the large-diameter portion 54. The engagement subject portion 54*a* is placed in contact with the engagement portions 41*a* and 42*a* of the lever member 40. The lower end of the large-diameter portion 54 establishes a fitting engagement with the lower holder 37 of the cartridge holder 32. The cap portion 52 has a planar lower surface portion 50*a* and a hole is formed on the lower surface portion 50*a* to allow the tip 6*a* of the cutting blade 6 to pass therethrough.

The grip portion 53 comprises a lid plate 56, a grip plate 57, and a rear surface plate 58 which are structurally integral. The lid plate 56 is fixed to the upper end of the case body 51. The grip plate 57 and the rear surface plate 58 are located on the upper side of the lid plate 56. The grip plate 57 is located on a lateral center of the lid plate 56 so as to be oriented in the longitudinal direction.

The cutting blade 6 comprises a cutter shaft 47 and the blade tip 6*a* which are structurally integral. The cutter shaft 47 is installed in the outer case 50 of the cartridge 4. The cutter shaft 47 occupies most of the cutting blade 6 and is shaped like a round bar. The blade tip 6*a* is located on one end of the cutting blade 6. The blade portion of the cutting blade 6 is shaped like a letter V which is slanted with respect to the workpiece 101. Further, a bearing is provided inside the case body 51. The bearing supports the cutter shaft 47 rotatably about its central axis 50*c*. The blade tip 6*a* protrudes from the lower surface portion 50*a* of the cap portion 52.

When cutting the workpiece 101, the control circuit 61 moves the cartridge 4 mounted on the cartridge holder 32 to the lowered position by the up-down drive mechanism 33 and sets the cutting pressure. When the cartridge 4 is in the lowered position, the blade tip 6*a* penetrates through the workpiece 101 placed on the holding sheet 10 and further slightly penetrates into the holding sheet 10. The workpiece 101 is cut by relatively moving the holding sheet 10 and the cutting blade 6 in the X and Y directions using the feed mechanism 7 and the transfer mechanism 8 with the cartridge 4 placed in the lowered position. In the cutting apparatus 1, an XY coordinate system is employed for example in which the origin O is set to the upper left corner of the adhesive layer 10*v* of the holding sheet 10 illustrated in FIG. 1. The workpiece 101 and the cutting blade 6 are moved in a relative manner based on the XY coordinate system.

[Electrical Configuration of Cutting Apparatus 1]

Figure 5:
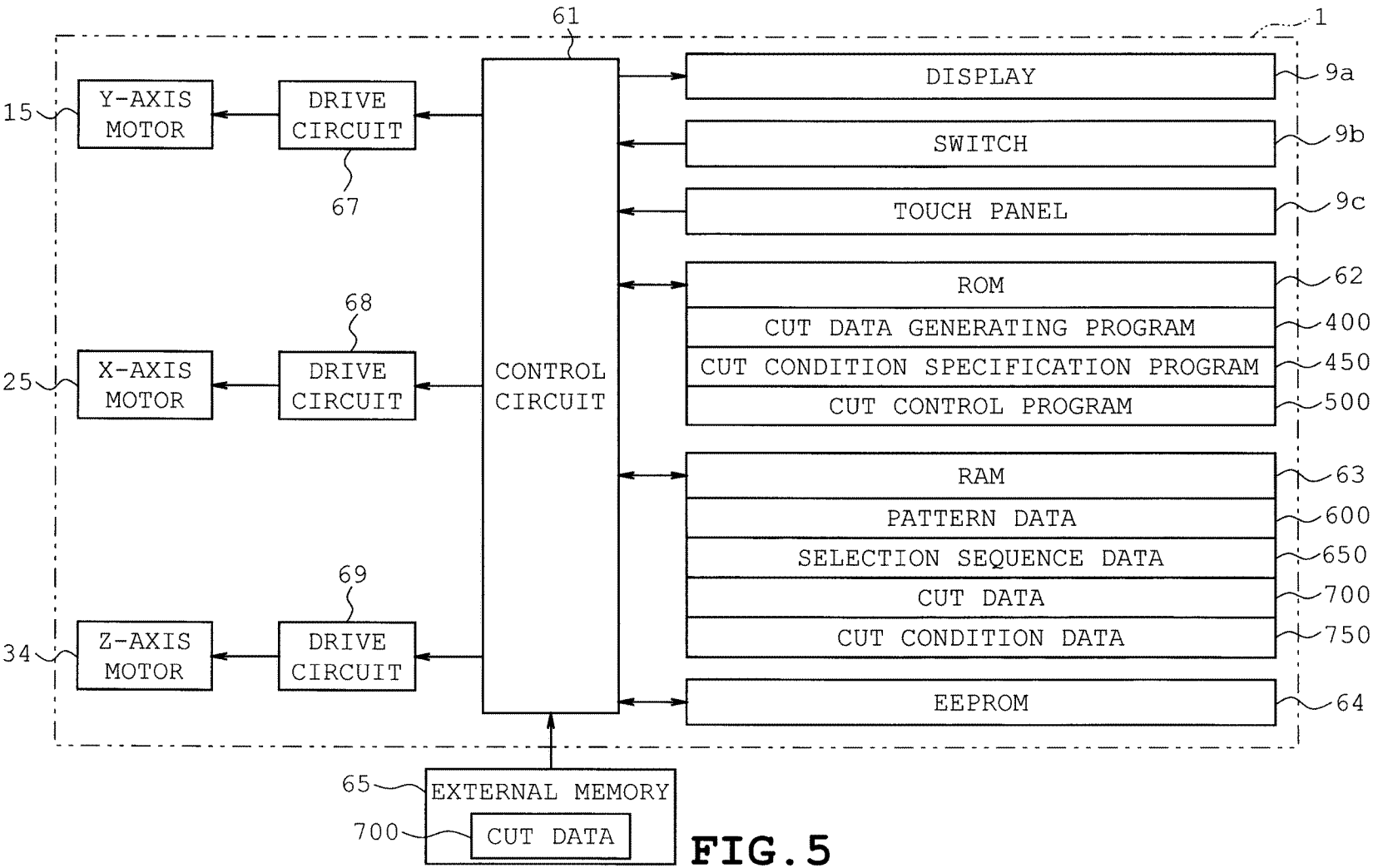
FIG. 5 is a block diagram schematically indicating an electrical configuration of the cutting apparatus 1.
Figure 6:
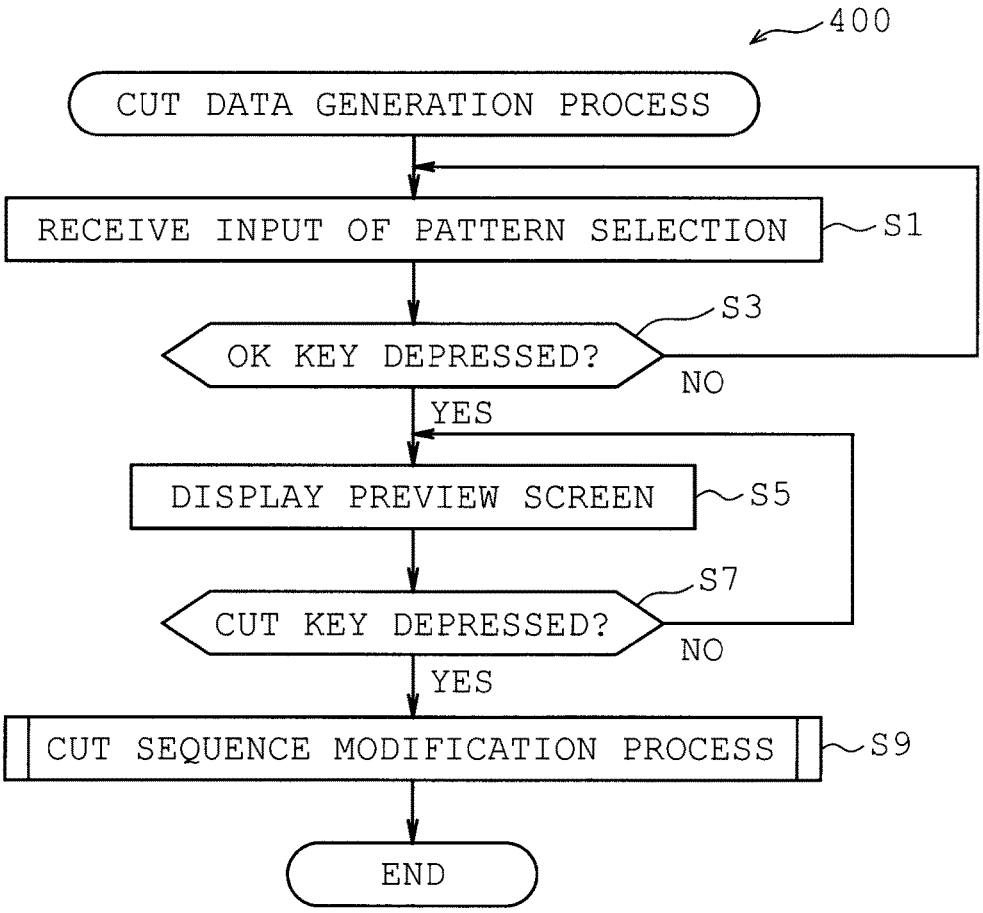
FIG. 6 is a flowchart indicating a cut data generating process 400.

Next, a description will be given on a control system of the cutting apparatus 1 with reference to FIG. 5. The control circuit 61 is responsible for the overall control of the cutting apparatus 1. The control circuit 61 is primarily configured by a computer (CPU). The control circuit 61 is electrically connected to a ROM 62, a RAM 63, an EEPROM 64, and external memory 65. The ROM 62 stores items such as a cut data generating program 400 for generating cut data 700, a cut condition specification program for specifying cut conditions, a cut control program 500 for controlling the cutting operation, a display control program for controlling the display 9*a* as well as the content being presented on the display 9*a*. The ROM 62, the RAM 63, and the external memory 65 serve as a storage unit storing cut data 700 used for cutting multiple types of patterns. The RAM 63 stores pattern data 600, selection sequence data 650, the cut data 700, and cut condition data 750.

The control circuit 61 is configured to implement the following through a software configuration by executing various programs stored in the ROM 62 by the CPU: a judging unit configured to execute a judging process, a determining unit configured to execute a determining process, a cut control unit configured to execute a cut control process, a continuation receiving unit (also referred to as a first receiving unit) configured to execute a continuation receiving process, a movement control process configured to execute a moving process, a pattern receiving unit (also referred to a second receiving unit) configured to execute a pattern receiving process, a storing unit configured to execute a storing process, and an a acquiring unit configured to execute an acquiring process. These processing units may be realized through a hardware configuration such as an integrated circuit inclusive of the control circuit 61 or by the cooperation of hardware and software configurations.

Signals are inputted to the control circuit 61 from switches 9*b*, etc. The control circuit 61 is electrically connected to the display 9*a* and the touch panel 9*c*. The user is allowed to select the desired patterns and various types of processing modes, and specify various parameters by operating the switches 9*b* or the touch panel 9*c* while referring to the information provided through the display 9*a*. Further, the control circuit 61 is electrically connected to drive circuits 67, 68, and 69 controlling driving a Y-axis motor 15, an X-axis motor 25, and a Z-axis motor 34, respectively. The control circuit 61 is configured to control elements such as the Y-axis motor 15, the X-axis motor 25, the Z-axis motor 34 based on the cut data 700 to automatically execute a cutting operation on the workpiece 101 placed on the holding sheet 10.

[Cut Data Generating Program 400]

Referring to FIGS. 6 to 12, a description is given on the cut data generating program 400. The cut data generating program 400 is executed by the control circuit 61 of the cutting apparatus 1. For example, when the user touches a key on the touch panel 9*c* that causes transition to the pattern selection screen 200, the control circuit 61 reads the cut data generating program 400 from the ROM 62 and executes the same. Upon execution of the cut data generating program 400, the control circuit 61 invokes the pattern selection screen 200 on the display 9*a*. Each of the steps indicated in the flowchart represents the process steps executed by the control circuit 61.

At step S1, the control circuit 61 receives user input of the selection of one or more patterns to be cut using the cut mechanism. When the user depresses a location on the touch panel 9*c* displaying the desired pattern 201 in the pattern selection screen 200 illustrated in FIG. 8 with a touch pen or the user's finger, the control circuit 61 stores pattern data 600 of the desired pattern to the RAM 63. Based on the pattern data 600 of the pattern selected by the user, the control circuit 61 calculates the central coordinate that the pattern selected by the user assumes when located on the holding sheet 10.

More specifically, the control circuit 61 calculates the central coordinate of the pattern selected by the user on the holding sheet 10 based on range of coordinate data in the X and the Y directions given in the pattern data 600 so that the patterns are disposed one after another in the rightward direction from the upper left portion of the holding sheet 10 in the order in which the patterns were selected by the user. Then, the control circuit 61 associates the pattern number of the pattern selected by the user with the selection sequence and central coordinate, and stores the information in the RAM 63 as selection sequence data 650. Further, when the user depresses a test key 202 in the pattern selection screen 200, a test pattern selection screen not illustrated is presented in the display 9*a* to allow the selection of one or more test patterns. The control circuit 61 stores the pattern data 600 corresponding to the selected test pattern in the RAM 63. The control circuit 61 similarly associates the pattern number of the pattern selected by the user with the selection sequence and central coordinate, and stores the information in the RAM 63 as selection sequence data 650 when a test pattern is selected by the user.

Referring to FIG. 10, a description is given on one example of pattern data 600. The pattern data 600 includes pattern numbers, coordinate data, and test pattern flag α. A pattern number is unique to each pattern and thus, differs from pattern to pattern. The pattern number of pattern 220 is P001. The pattern number of pattern 230 is P002. The pattern number of pattern 240 is T002. The pattern number of pattern 250 is T004. Patterns 230 and 240 are test patterns. Patterns 220 and 250 are normal patterns. A normal pattern is a pattern which is not a test pattern. A normal pattern may be formed of various shapes. As later described in detail, a test pattern is used to evaluate the quality of the cutting operation such as whether or not the workpiece 101 has been completely cut. The coordinate data is represented in X-Y coordinate system. More specifically, the coordinate data indicates the shape of the pattern by taking the center of the pattern as an origin. The test pattern flag α is set to "1" in the pattern data for test patterns, eg. pattern numbers T002 and T004. The test pattern flag α is set to "0" in the pattern data for normal patterns, eg. pattern numbers P001 and P002. The test pattern 230 is a triangle. The test pattern 240 is a circle. The normal pattern 220 is a notched circle. The normal pattern 250 is a parallelogram.

A description is given hereinafter on selection sequence data 650 with reference to FIG. 11. The selection sequence data 650 associates selection sequence i of the pattern selected by the user with the pattern number of the pattern selected by the user and the central coordinate on the holding sheet 10 of the pattern selected by the user. The present embodiment is described through an example in which the user has selected the normal pattern 220, the test pattern 230, the test pattern 240, and the normal pattern 250 in the listed sequence. The pattern number of the firstly selected pattern is P001. The pattern number of the secondly selected pattern is T002. The pattern number of the thirdly selected pattern is T004. The pattern number of the fourthly selected pattern is P002. The pattern is located on the holding sheet 10 so that the origin of the pattern data 600 and the central coordinate of the pattern coincide.

At step S3, the control circuit 61 judges whether or not an OK key not illustrated in the pattern selection screen 200 has been depressed. Upon determining that the OK key has been depressed (step S3: YES), the process flow proceeds to step S5. Upon determining that the OK key has not been depressed (step S3: NO), the process flow returns to step S1. The control circuit 61 is allowed to determine the pattern to cut by the user's depression of the OK key.

At step S5, the control circuit 61 invokes a preview screen 210 on the display 9*a*. More specifically, the control circuit 61 transmits a control signal to the display 9*a* for invoking the preview screen 210. The display 9*a* invokes the preview screen 210 according to the control signal given from the control circuit 61. As illustrated in the preview screen 210 presented in FIG. 9, the multiple patterns selected by the user are laid out one after another in the rightward direction from the upper left portion of a display region 260 provided on the preview screen 210 in the order in which the patterns were selected by the user. The display region 260 indicates the region in which the cutting apparatus 1 is capable of cutting the workpiece 101. By invoking the preview screen 210 on the display 9*a*, the user is allowed to visualize the location of patterns to be cut on the holding sheet 10 prior to the actual cutting operation. In this example, the patterns are laid out in the listed sequence of the normal pattern 220, the test pattern 230, the test pattern 240, and the normal pattern 250.

Figure 9:
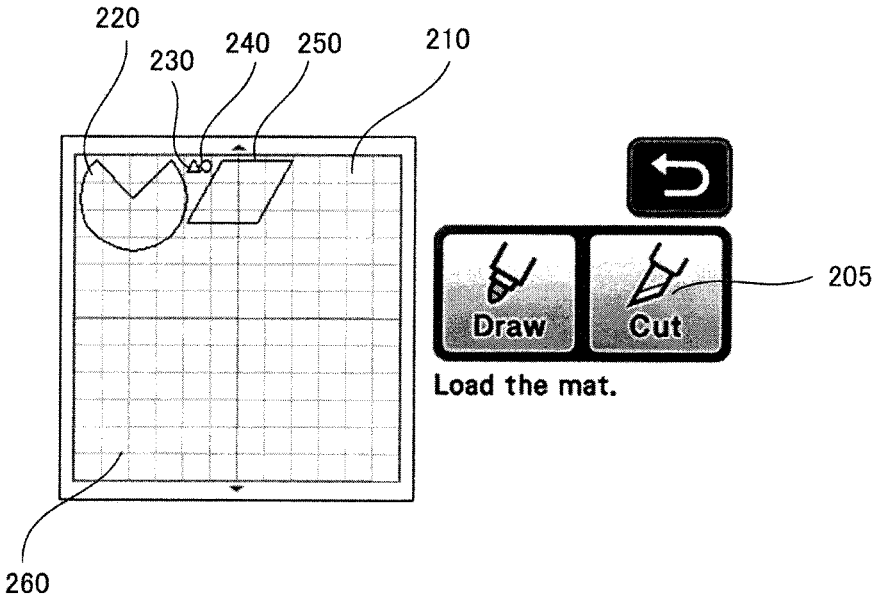
FIG. 9 illustrates a preview screen 210.

A description is given hereinafter on the details of the test pattern. The test pattern is used to evaluate the quality of cuts made on the workpiece 101 by the cutting blade 6. An angular shape, especially an acute angle, is the most difficult shape to cut for the cutting apparatus 1 compared to other shapes. It is thus, preferable for the user to choose a test pattern containing an angular shape to ensure that the angular shapes in the actual pattern are properly cut. A simple shape is preferred for a test pattern to facilitate user verification of the cut quality. The test pattern formed by cutting the workpiece 101 is not used and thus, disposed of. Thus, the test patterns are formed in smaller sizes compared to the normal patterns as illustrated in FIG. 9 to prevent unnecessary consumption of the workpiece 101.

At step S7, the control circuit 61 judges whether or not a cut key 205 has been depressed in the preview screen 210. Upon determining that the cut key 205 has been depressed (step S7: YES), the process flow proceeds to step S9. Upon determining that the cut key 205 has not been depressed (step S7: NO), the process flow returns to step S5.

At step S9, the control circuit 61 executes a cut sequence determining process. The control circuit 61 terminates the cut data generating program 400 after completing step S9.

[Cut Sequence Determining Process Step S9]

Figure 7:
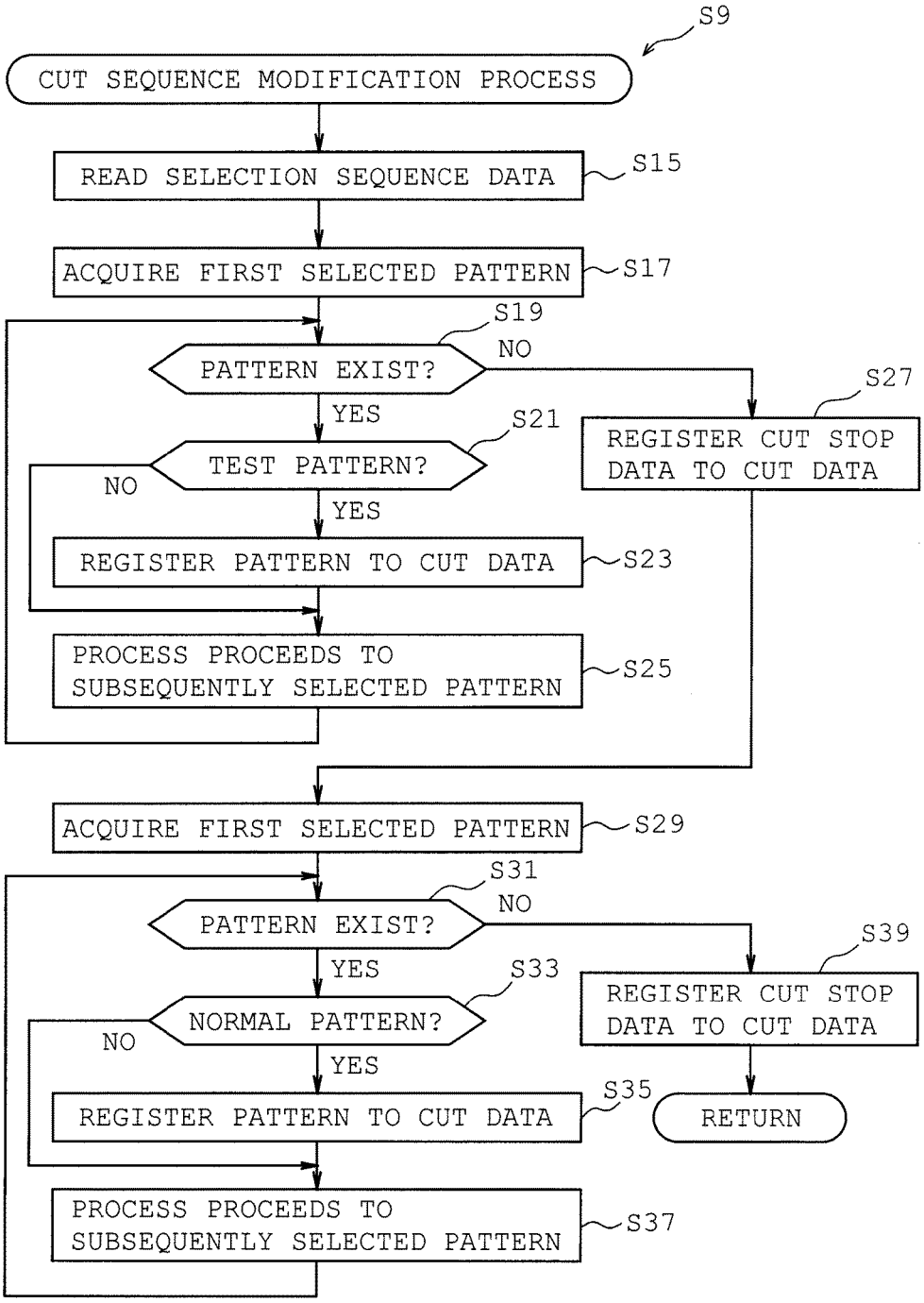
FIG. 7 is a flowchart indicating a process flow of a cut sequence determining process of step S9.
Figure 8:
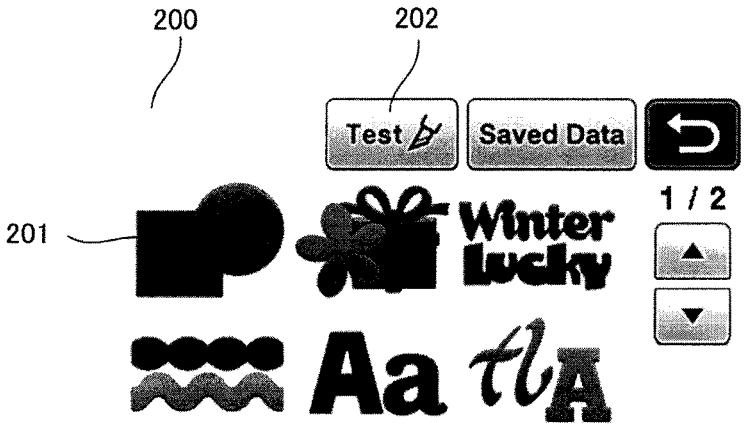
FIG. 8 illustrates a pattern selection screen 200.

Referring to FIG. 7 a description is given in detail on the cut sequence determining process executed at step S9. The control circuit 61 starts the cut sequence determining process of step S9 with step S15 indicated in the flowchart of FIG. 7.

At step S15, the control circuit 61 reads the selection sequence data 650 from the RAM 63.

At step S17, the control circuit 61 acquires the firstly selected pattern. More specifically, the control circuit 61 assigns "1" in the parameter "i". The control circuit 61 acquires an entry of pattern data associated with the pattern number of the firstly selected pattern from the pattern data 600. In the present embodiment, the control circuit 61 acquires the entry of pattern data associated with the pattern number P001 of the firstly selected pattern from the pattern data 600 stored in the RAM 63.

At step S19, the control circuit 61 judges the presence/absence of an unprocessed pattern number in the selection sequence data 650. More specifically, the control circuit 61 judges whether or not a pattern number exists in the ith entry of the selection sequence pattern data 650. Upon determining that a pattern number exists in the ith entry of the selection sequence pattern data 650 (step S19: YES), the control circuit 61 proceeds the process to step S21. Upon determining that a pattern number exists in the ith entry of the selection sequence pattern data 650 (step S19: NO), the control circuit 61 proceeds the process to step S27. Step S19 allows the control circuit 61 to exhaustively process each and every pattern selected by the user.

At step S21, the control circuit 61 judges whether or not the ith selected pattern is a test pattern. More specifically, the control circuit 61 judges whether or not the test pattern flag α of the pattern data 600 of the ith selected pattern is "1". Upon determining that the test pattern flag α of the pattern data 600 of the ith selected pattern is "1" (step S21: YES), the control circuit proceeds to step S23. Upon determining that the test pattern flag α of the pattern data 600 of the ith selected pattern is not "1" (step S21: NO), the control circuit proceeds to step S25.

At step S23, the control circuit 61 registers the pattern determined to be a test pattern at step S21 to cut data 700. More specifically, the control circuit 61 generates cut data 700 in which the cut sequence has been determined, i.e. modified so that the pattern determined to be a test pattern at step S21 is cut before a normal pattern which was not determined to be a test pattern at step S21. The cut sequence indicates the sequence, i.e. the order in which the patterns are cut from the workpiece 101 using the cutting blade 6. The control circuit 61 stores the generated cut data 700 in the RAM 63. More specifically, the control circuit 61 converts the coordinate data of the pattern data 600, determined to represent test patterns, into coordinate data which establishes an origin O at the upper left corner of the holding sheet 10 based on the central coordinate provided in the selection sequence data 650. More specifically, the control circuit 61 converts the coordinate data provided in the pattern data 600 into coordinate data plotted on the holding sheet 10 so that the origin of the coordinate data of the pattern data 600 determined to represent test patterns and the central coordinates provided in the selection sequence data 650 coincide. The control circuit 61 stores the generated cut data 700 in the RAM 63.

At step S25, the control circuit 61 proceeds to process the subsequently selected pattern. More specifically, the control circuit 61 increments the parameter "i" by "1". Then, the control circuit 61 identifies the pattern number of the ith selected pattern from the selection sequence data 650. The control circuit 61 acquires the pattern data associated with the pattern number of the ith selected pattern from the pattern data 600. After completing step S25, the control circuit 61 returns the process flow to step S19.

At step S27, the control circuit 61 registers cut stop data to the cut data 700. The cut stop data is used to temporarily stop the cutting.

At step S29, the control circuit 61 acquires the first selected pattern as was the case in step S17.

At step S31, the control circuit 61 judges whether or not an unprocessed pattern number exists in the selection sequence data 650 as was the case in step S19.

At step S33, the control circuit 61 judges whether or not the ith selected pattern is a normal pattern. More specifically, the control circuit 61 judges whether or not the test pattern flag α of the pattern data 600 of the ith selected pattern is "0". Upon determining that the test pattern flag α of the ith selected pattern is "0" (step S33: YES), the control circuit proceeds to step S35. Upon determining that the test pattern flag α of the ith selected pattern is not "0" (step S33: NO), the control circuit proceeds to step S37.

At step S35, the control circuit 61 registers the normal pattern which was not determined to be a test pattern at step S33 to cut data 700. More specifically, the control circuit 61 generates cut data 700 in which the cut sequence has been determined, i.e. modified so that the normal pattern which was not determined to be a test pattern at step S21 is cut after the pattern determined to be a test pattern at step S21. The control circuit 61 stores the generated cut data 700 to the RAM 63. More specifically, the control circuit 61 converts the coordinate data of the pattern data 600, determined to represent normal patterns, into coordinate data which establishes an origin O at the upper left corner of the holding sheet 10 based on the central coordinate provided in the selection sequence data 650. More specifically, the control circuit 61 converts the coordinate data provided in the pattern data 600 into coordinate data plotted on the holding sheet 10 so that the origin of the coordinate data of the pattern data 600 determined to represent normal patterns and the central coordinates provided in the selection sequence data 650 coincide. The control circuit 61 stores the generated cut data 700 in the RAM 63.

At step S37, the control circuit 61 proceeds to process the subsequently selected pattern as was the case in step S25. After completing step S37, the control circuit 61 returns the process flow to step S31.

At step S39, the control circuit 61 registers cut stop data to the cut data 700. After completing step S39, the control circuit 61 terminates the cut sequence determining process (step S9) and terminates the cut data generating program 400.

Referring to FIG. 12, a description is given in detail on the cut data 700. The cut data 700 is used for cutting multiple patterns from the workpiece 101 with the cutting blade 6. The cut date 700 includes coordinate data and cut end data. The coordinate data and the cut end data are associated with processing sequence j. Process sequence j is a parameter indicating the order in which the entries of data provided in the cut data 700 are processed. The coordinate data is used for moving the workpiece 101 and the cutting blade 6 in the X and Y directions by the transfer mechanism 8 and the feed mechanism 7.

[Cut Condition Specification Program 450]

Figure 13:
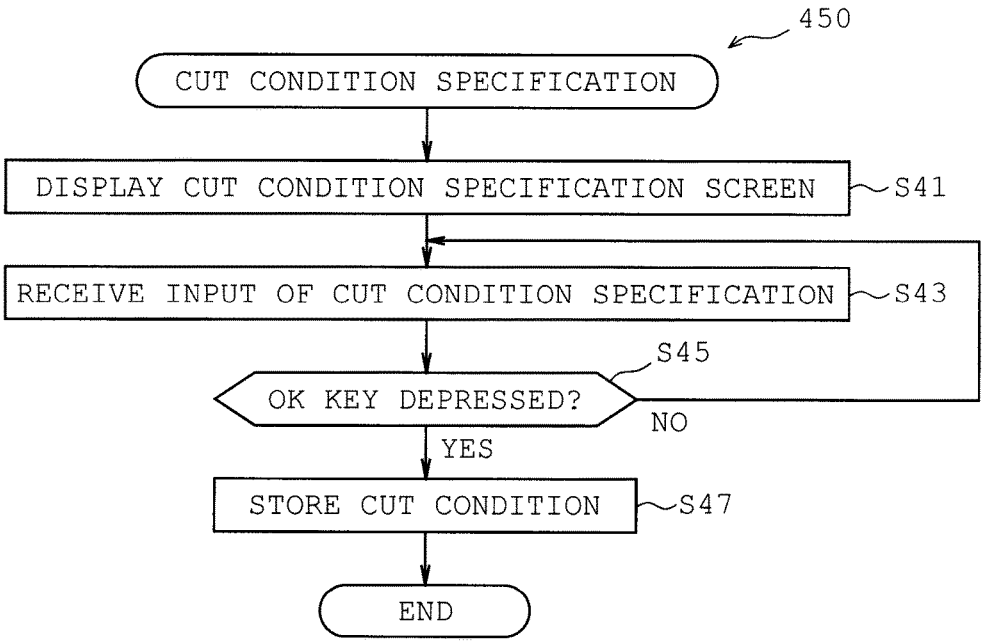
FIG. 13 is a flowchart indicating the process flow of a cut condition specification process 450.
Figure 14:
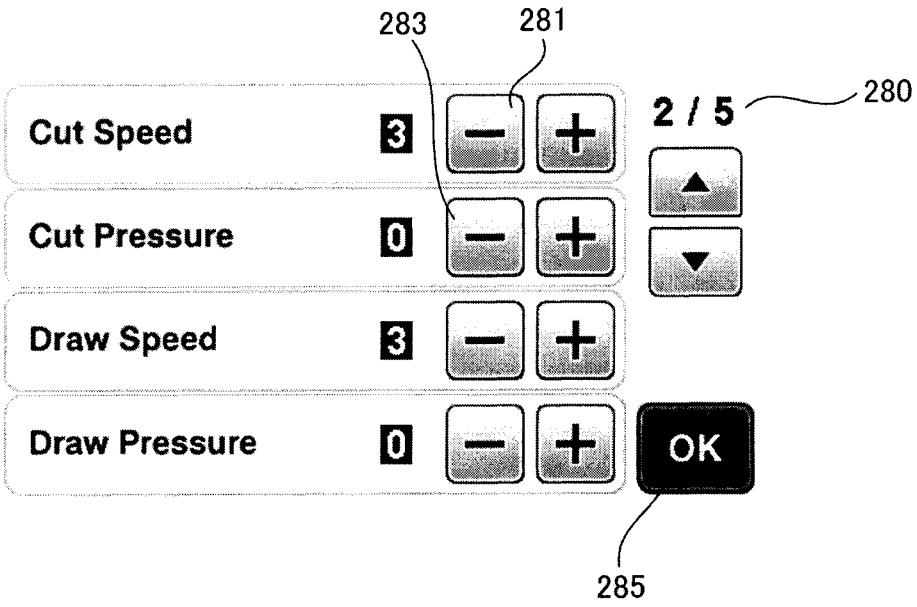
FIG. 14 illustrates a cut condition specification screen 280.

Referring now to FIGS. 13 and 14, a description is given on the cut condition specification process 450. The cut condition specification process 450 is executed by the control circuit 61 of the cutting apparatus 1. For example, when the user depresses a key on the touch panel 9*c* for making a transition to a cut condition specification screen 280, the control circuit 61 reads the cut condition specification process 450 from the ROM 62 and executes the same.

At step S41, the control circuit 61 invokes the cut condition specification screen 280 on the display 9*a*. More specifically, the control circuit 61 transmits a control signal to the display 9*a* for invoking the cut condition specification screen 280. The display 9*a* invokes the cut condition specification screen 280 according to the control signal given from the control circuit 61. Even more specifically, the control circuit 61 reads image information depicting the cut condition specification screen 280 from the ROM 62 and transmits the image signal to the display 9*a*. The cut condition specification screen 280 is used for specifying cut conditions. Examples cut conditions include parameters such as movement speed of the cutting blade 6 and cutting pressure.

At step S43, the control circuit 61 receives user specification of cut conditions. For example, the user is allowed to specify the movement speed in 5 levels ranging from 1 to 5 by touching the +– key 281. The user is allowed to specify the cutting pressure in 19 levels ranging from –9 to +9 by touching the +– key 283. As a result, the user is allowed to specify the cut conditions in detail and thus, allowed to specify the desired cut conditions.

At step S45, the control circuit 61 judges whether or not an OK key 285 has been depressed in the cut condition specification screen 280. Upon determining that the OK key 285 has been depressed (step S45: YES), the control circuit 61 proceeds to step S47. Upon determining that the OK key 285 has not been depressed (step S45: NO), the control circuit 61 returns the process flow to step S43. It is possible to determine the cut conditions by depressing the OK key 285 at step S45.

At step S47, the control circuit 61 stores the cut conditions specified at step S43 to RAM 63 as cut condition data 750. The cut condition data 750 includes items such as movement speed and cutting pressure. In the present embodiment, the movement speed is set to 3 and the cutting pressure is set to 0. After storing the cut condition data 750 to the RAM 63, the cut conditions to be applied to the cutting apparatus 1 is determined, i.e. modified. After completing step S47, the cut condition specification process 450 is terminated.

[Cut Control Program 500]

Figure 15:
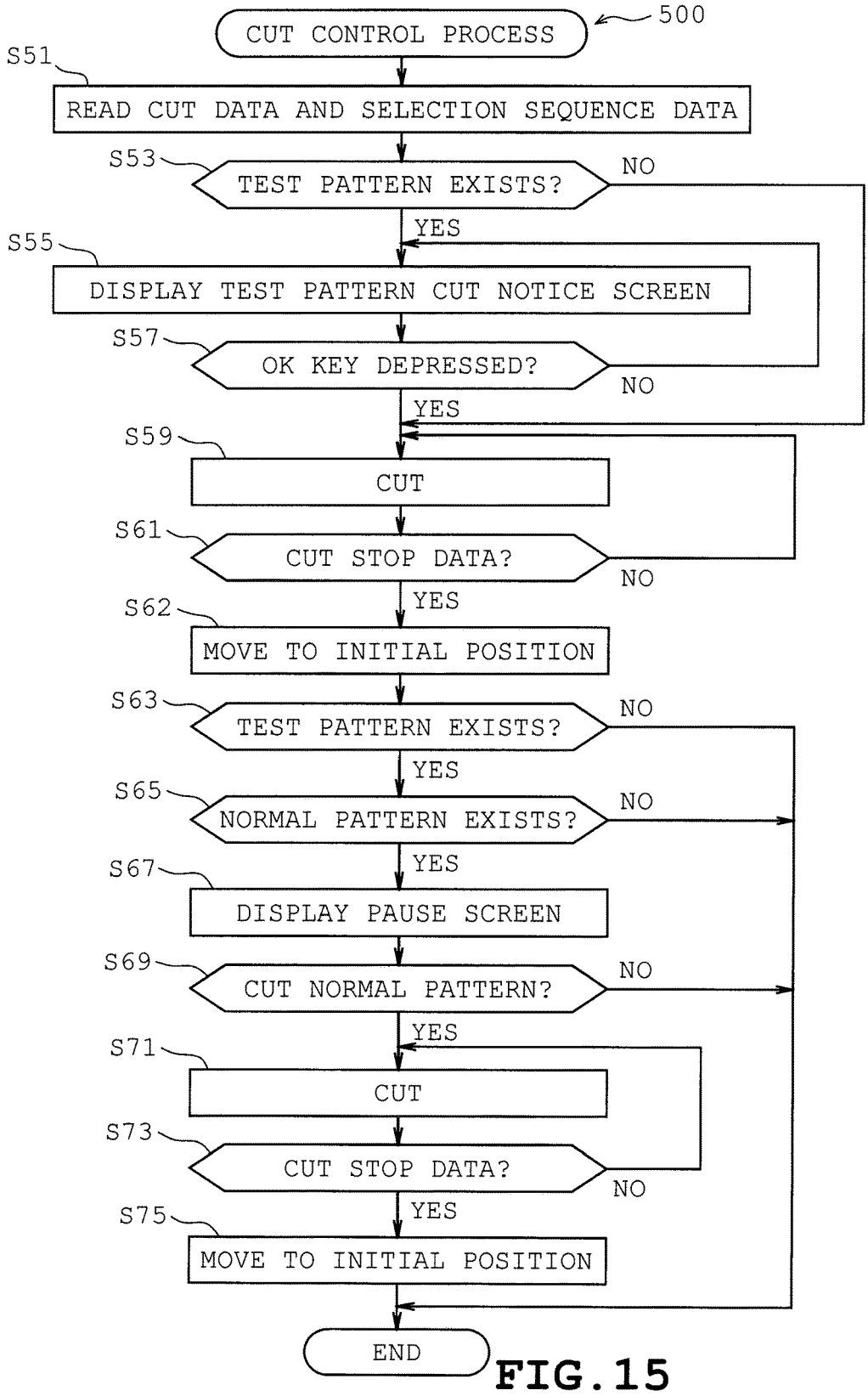
FIG. 15 is a flowchart indicating the process flow of a cut control process 500.
Figure 16:
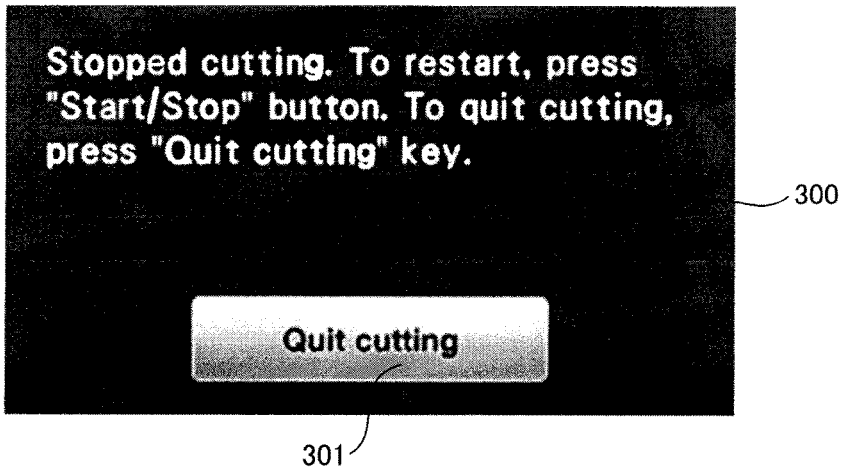
FIG. 16 illustrates a pause screen 300.

Referring now to FIGS. 15 and 16, a description is given on a cut control process 500. The cut control process 500 is executed by the control circuit 61 of the cutting apparatus 1. The cutting operation of the cutting apparatus 1 is started by the user's depression of the start button which is one of the multiple switches 9*b* provided in the cutting apparatus 1. The control circuit 61 reads the cut control program 500 from the ROM 62 and executes the same.

At step S51, the control circuit 61 reads the cut data 700 and the selection sequence data 650 from the RAM 63.

At step S53, the control circuit 61 judges the presence/absence of test patterns in the patterns to be cut. More specifically, the control circuit 61 reads pattern data 600 associated with every pattern number stored in the selection sequence data 650. The control circuit 61 judges whether or not the test pattern flag α of each of the patterns in the pattern data 600 is "1". When finding pattern data determined to have the test pattern flag α set to "1" (step S53: YES) as the result of performing the above described judging process through the entire pattern data 600, the control circuit 61 proceeds to step S55. When there is no pattern data determined to have the test pattern flag α set to "1" (step S53: NO), the control circuit 61 proceeds to step S59.

At step S55, the control circuit 61 invokes a test pattern cut notice screen on the display 9*a*. The test pattern cut notice screen displays a message informing the user that cutting blade 6 will be cutting a test pattern prior to a normal pattern. More specifically, the control circuit 61 transmits a control signal to the display 9*a* for invoking the test pattern cut notice screen. The display 9*a* invokes the test pattern cut notice screen according to the control signal given from the control circuit 61. Even more specifically, the control circuit 61 reads image information depicting the test pattern cut notice screen from the ROM 62 and transmits the image signal to the display 9*a*. The test pattern cut notice screen includes an OK key to be depressed by the user to accept cutting test patterns.

At step S57, the control circuit 61 receives user selection of whether or not to proceed with the cutting of test patterns. More specifically, the control circuit 61 judges whether or not the OK key has been depressed in the test pattern cut notice screen. Upon determining that the OK key has been depressed in the test pattern cut notice screen (step S57: YES), the control circuit 61 proceeds to step S59. Upon determining that the OK key has not been depressed in the test pattern cut notice screen (step S57: NO), the control circuit 61 returns the process flow to step S55.

At step S59, the control circuit 61 controls the drive of the movement portion 20 so that the cutting blade 6 cuts the test patterns. More specifically, the control circuit 61 executes the cutting process according to the coordinate data provided in the cut data 700 and the cut conditions stored as the cut condition data 750. The control circuit 61 sequentially reads out the coordinate data provided in the cut data cut data 700 according to the processing sequence j. The control circuit 61 transfers the cutting blade 6 in the X direction by the transfer mechanism 8 while feeding the holding sheet 10 holding the workpiece 101 in the Y direction by the feed mechanism 7 according to the read out coordinate data.

More specifically, the control circuit 61 outputs control signals to drive circuits 67, 68, and 69 according to coordinate data. Upon receiving control signals from the control circuit 61, the drive circuits 67, 68, and 69 drive the Y-axis motor 15, the X-axis motor 25, and the Z-axis motor 34, respectively. The control circuit 61 increments the processing sequence j by "1" and proceeds to step S61 in order to process the subsequent data in the cut data 700. In the present embodiment, the cutting apparatus 1 cuts the workpiece 101 along the outlines of test patterns 230 and 240 so that the cutting progresses in the order of the test pattern 230 and the test pattern 240.

At step S61, the control circuit 61 judges whether or not the ith data of the cut data 700 is cut stop data. Upon determining that the ith data is cut stop data (step S61: YES), the control circuit 61 proceeds to step S62. Upon determining that the ith data is not cut stop data (step S61: NO), the control circuit 61 returns the process flow to step S59.

At step S62, the control circuit 61 moves the cutting blade 6 and the holding sheet 10 to their initial positions. More specifically, the control circuit 61 moves the blade tip 6*a* away from the workpiece 101 and moves the cartridge 4 to the lifted position so that the cutting blade 6 does not cut any other portions of the workpiece 101 except the patterns. The control circuit 61 further controls the drive roller 12 to move the edge portion 10*c* of the holding sheet 10, located at the rear end of the workpiece 101, to be disposed below the pinch roller 13. Thus, the pinch roller 13 is disposed above the drive roller 12 over the workpiece 101. Further, the control circuit 61 executes a control to move the carriage 19 to the position illustrated in FIGS. 1 and 2. More specifically, the control circuit 61 executes a control to move the carriage 19 to a position above the edge portion 10*a* of the holding sheet 10 located at the right end of the workpiece 101.

At step S63, the control circuit 61 judges the presence/absence of a test pattern in the cut patterns as was the case in step S53. When finding pattern data determined to have the test pattern flag α set to "1" (step S63: YES) as the result of performing the above described judging process through the entire pattern data 600, the control circuit 61 proceeds to step S65. When there is no pattern data determined to have the test pattern flag α set to "1" (step S63: NO), the control circuit 61 terminates the cut control process 500.

At step S65, the control circuit 61 judges the presence/absence of a normal pattern in the cut patterns through a process similar to the process executed in step S53. More specifically, the control circuit 61 reads pattern data 600 associated with every pattern number stored in the selection sequence data 650. The control circuit 61 judges whether or not the test pattern flag α of each of the patterns in the pattern data 600 is "0". When finding pattern data determined to have the test pattern flag α set to "0" (step S65: YES) as the result of performing the above described judging process through the entire pattern data 600, the control circuit 61 proceeds to step S67. When there is no pattern data determined to have the test pattern flag α set to "0" (step S65: NO), the control circuit 61 terminates the cut control process 500.

At step S67, the control circuit 61 invokes a pause screen 300 illustrated in FIG. 16 on the display 9*a*. The pause screen 300 displays a message informing the user that: the cutting apparatus 1 is tentatively stopped, the user is required to depress the start button to restart the cutting process, and that the user is required to depress a cut stop key 301 in the pause screen 300 to stop the cutting operation. More specifically, the control circuit 61 transmits a control signal to the display 9*a* for invoking the pause screen 300. The display 9*a* invokes the pause screen 300 according to the control signal given from the control circuit 61. Even more specifically, the control circuit 61 reads image information depicting the pause screen 300 from the ROM 62 and transmits the image signal to the display 9*a*.

At step S69, the control circuit 61 judges whether or not to cut normal patterns after cutting test patterns by step S59. Stated differently, the control circuit 61 allows the selection of whether or not to continue the cutting process after the test patterns have been cut using the cutting blade 6 by step S59. More specifically, the control circuit 61 judges whether the start button has been depressed or the cut stop key 301 has been depressed. Upon determining that the start button has been depressed (step S69: YES), the control circuit 61 proceeds to step S71. Upon determining that the cut stop key 301 has been depressed (step S69: NO), the control circuit 61 terminates the cut control process 500.

At step S71, the control circuit 61, upon receiving the user selection to continue the cutting process at step S69, controls the drive of the movement portion 20 so that the cutting blade 6 cuts the normal patterns. More specifically, the control circuit 61 executes the cutting process according to the cut conditions stored as the cut condition data 750 and according to the coordinate data provided in the cut data 700. The control circuit 61 sequentially reads the cut data 700 according to processing sequence j. The control circuit 61 transfers the cutting blade 6 in the X direction by the transfer mechanism 8 while feeding the holding sheet 10 holding the workpiece 101 in the Y direction by the feed mechanism 7 according to the read out coordinate data. More specifically, the control circuit 61 outputs control signals to drive circuits 67, 68, and 69 according to coordinate data. Upon receiving control signals from the control circuit 61, the drive circuits 67, 68, and 69 drive the Y-axis motor 15, the X-axis motor 25, and the Z-axis motor 34, respectively. The control circuit 61 increments the processing sequence j by "1" and proceeds to step S61 in order to process the subsequent data in the cut data 700. In the present embodiment, the cutting apparatus 1 cuts the workpiece 101 along the outlines of normal patterns 220 and 250 so that the cutting progresses in the order of the normal pattern 220 and the test pattern 250.

At step S73, the control circuit 61 judges whether or not the ith data of the cut data 700 is cut stop data. Upon determining that the ith data is cut stop data (step S73: YES), the control circuit 61 proceeds to step S75. Upon determining that the ith data is not cut stop data (step S61: NO), the control circuit 61 returns the process flow to step S71.

At step S75, the control circuit 61 moves the cutting blade 6 and the holding sheet 10 to their initial positions. More specifically, the control circuit 61 controls the drive roller 12 to move below the edge portion 10*c* of the holding sheet 10 which is located at the rear end of the workpiece 101. Further, the control circuit 61 executes a control to move the carriage 19 to a position above the edge portion 10*a* of the holding sheet 10 located at the right end of the workpiece 101. After completing step S75, the control circuit 61 terminates the cut control process 500.

Effects of the Present Embodiment

At step S69, the control circuit 61 allows the user to select whether or not to continue the cutting process after the test patterns have been cut using the cutting blade 6 by step S59. At this instance, the user is given an opportunity to evaluate the quality of cuts made by the cutting blade 6 in forming test patterns on the workpiece 101. When the user has found the cut quality to be good, the user is to depress the start button to continue the cutting process. When the user has found the cut quality to be poor, the user is allowed to not proceed with the cutting of normal patterns by depressing the cut stop key 301 and modify the cut conditions. As a result, it is possible to prevent the cutting process of normal patterns to be performed under conditions providing poor cut quality. Thus, it is possible to eliminate unnecessary consumption of workpiece 101.

At step S62, the control circuit 61 controls the drive roller 12 to move the holding sheet 10 so that the edge portion 10*c* of the holding sheet 10, located at the rear end of the workpiece 101, is located below the pinch roller 13. Further, the control circuit 61 executes a control to move the carriage 19 to a position above the edge portion 10*a* of the holding sheet 10 located at the right end of the workpiece 101. Since the pinch roller 13 and the carriage 19 are not located above the portions of the workpiece 101 which has been cut, the user is allowed to evaluate the quality of cuts made by the cutting blade 6 in forming test patterns on the workpiece 101 with ease.

At step S63, the control circuit 61 invokes a screen on the display 9*a* informing the user that the test patterns are going to be cut by the cutting blade 6 before the normal patterns are cut. As a result, it is possible for the user to learn that the test patterns are going to be cut before the normal patterns are cut.

The test pattern is smaller than the normal pattern. Thus, it is possible to reduce the consumption of the workpiece 101 for evaluating the cut quality as compared to the case in which the test patterns are sized the same as the normal pattern. Further, because the test pattern is smaller than the normal pattern, it is possible to dispose the test pattern in a vacant space remaining on the workpiece 101 and thereby reduce consumption of the workpiece 101.

Modified Embodiments

The present disclosure is not limited to the embodiment described above but may be implemented in various other embodiments within the spirit of the disclosure.

The movement portion 20 is configured to cut the workpiece 101 into a desired shape by transferring the cutting blade 6 in the X direction by the transfer mechanism 8 and feeding the workpiece 101 by the feed mechanism 7. However, the movement portion may be configured to cut the workpiece 101 by transferring the cutting blade 6 in both the X and Y directions without feeding the workpiece 101.

At step S69, the control circuit 61 allows the user to select whether or not to continue the cutting process after the test patterns have been cut using the cutting blade 6 by step S59. When the user has found the cut quality to be good, the user is to depress the start button to continue the cutting process. Alternatively, the control circuit 61 may be configured to continue the cutting process after a lapse of a predetermined time period after completing the cutting of test patterns. An example of a predetermined time period may be 60 seconds. In such case, the user is required to evaluate the cut quality of the test patterns within the predetermined time period. When the user has found the cut quality to be good, the user is to wait for the lapse of the predetermined time period, whereafter the cutting process will be continued. In contrast, when the user has found the cut quality to be poor, the user is to depress the cut stop key 301 within the predetermined time period and proceed to modify the cut conditions. Alternatively, the control circuit 61 may be configured to terminate the cutting operation after the lapse of the predetermined time period after completing the cutting of test patterns. When the user has found the cut quality to be good, the user is to depress the start button to continue the cutting process.

At step S62, the control circuit 61 is configured to control the drive roller 12 to move the holding sheet 10 so that the edge portion 10*c* of the holding sheet 10, located at the rear end of the workpiece 101, is located below the pinch roller 13. Further, the control circuit 61 is configured to execute a control to move the carriage 19 to a position above the edge portion 10*a* of the holding sheet 10 located at the right end of the workpiece 101. Alternatively, the control circuit 61 may be configured to control the drive roller 12 to move the holding sheet 10 so that the edge portion 10*d* of the holding sheet 10, located at the front end of the workpiece 101, is located below the pinch roller 13 and to execute a control to move the carriage 19 to a position above the edge portion 10*b* of the holding sheet 10 located at the left end of the workpiece 101. The pinch roller 13 and the carriage 19 may be moved to any other positions as long as they do not get in the way of the user when evaluating the cut quality of test patterns.

In the embodiment described above, the test pattern is smaller than the normal pattern. Alternatively, the size of the test pattern may be equal to or greater than the size of the normal pattern.

At step S9, the control circuit 61 is configured to modify the cut sequence when registering the cut data 700. Alternatively, the control circuit 61 may be configured to rearrange the selection sequence defined in the selection sequence data 650 so that the test pattern is cut before the normal pattern and thereafter register the cut data 700 containing the rearranged sequence as the cut sequence.

The cut data generation program 400 may be stored in a computer readable storing medium such as a hard disk, a flexible disk, a CD-ROM, a DVD or the like. In such case, the computer readable storing medium may be read and executed through a computer such a personal computer. Further, the cut data generation program 400 may be a transmission medium which is capable of being distributed over a network such as the internet.

The cutting apparatus 1 is one example of a cutting apparatus.

The cut data generating program 400 is one example of a cut data generating program.

The pattern data 600 is one example of a collection of plural patterns.

The left and right direction (X direction) in which the transfer mechanism 8 is moved is one example of a first direction.

The forward and rearward direction (Y direction) in which the feed mechanism 7 is moved is one example of a second direction.

The control circuit 61 configured to execute step S1 is one example of a storage unit and a storing process.

The control circuit 61 configured to execute step S1 is one example of a pattern selection receiving unit and a pattern selection receiving process.

The control circuit 61 configured to execute steps S17, S25, S29, and S37 is one example of an acquiring unit and an acquiring process.

The control circuit 61 configured to execute steps S21 and S33 is one example of a judging unit and a judging process.

The control circuit 61 configured to execute steps S23 and S35 is one example of a determining unit and a determining process.

The control circuit 61 configured to execute cut control process 500 is one example of a cut control unit and a cut control process.

The control circuit 61 configured to execute step S55 is one example of a display processing unit and a display process.

The control circuit 61 configured to execute steps S59, S61, and S62 is one example of a cut control unit and a cut control process.

The control circuit 61 configured to execute step S69 is one example of a continuation receiving unit and a continuation receiving process.

The control circuit 61 configured to execute steps S71, S, S73, and S75 is one example of a cut control unit and a cut control process.

The display 9*a* is one example of a display unit.

The carriage 19 is one example of a carriage.

The drive roller 12 is one example of a roller.

In the embodiments described above, a single CPU may perform all of the processes. Nevertheless, the disclosure may not be limited to the specific embodiment thereof, and a plurality of CPUs, a special application specific integrated circuit ("ASIC"), or a combination of a CPU and an ASIC may be used to perform the processes.

The foregoing description and drawings are merely illustrative of the principles of the disclosure and are not to be construed in a limited sense. Various changes and modifications will become apparent to those of ordinary skill in the art. All such changes and modifications are seen to fall within the scope of the disclosure as defined by the appended claims.

I claim:

1. A cutting apparatus comprising:

a cut mechanism configured to cut a workpiece; and a control device configured to:

judge whether or not each of plural patterns to be cut by the cut mechanism is a test pattern used for evaluating a cut quality of the workpiece cut by the cut mechanism;

determine a cut sequence, the cut sequence indicating a sequence in which the plural patterns are cut from the workpiece by the cut mechanism, the cut sequence being determined so that a pattern judged as the test pattern is cut before a normal pattern is cut, the normal pattern being a pattern judged to not be the test pattern; and control the cut mechanism to cut the plural patterns from the workpiece according to the cut sequence.

2. The cutting apparatus according to claim 1, wherein the control device is further configured to:

receive instructions to select whether or not to continue cutting after cutting the test pattern according to the cut sequence; and control the cut mechanism to cut the normal pattern when receiving instructions to select continuation of cutting.

3. The cutting apparatus according to claim 2, wherein the cut mechanism is provided with a cut blade and a carriage configured to transfer the cut blade along a first direction, and wherein the cut mechanism is configured to cut the workpiece using the cut blade.

4. The cutting apparatus according to claim 3, wherein the control device is further configured to control the carriage to transfer the cut blade toward a first end of the first direction after cutting the test pattern by the cut blade and configured to control the carriage to transfer the cut blade toward a second end of the first direction opposite the first end when receiving instructions to select continuation of cutting.

5. The cutting apparatus according to claim 2, further comprising a transfer mechanism configured to transfer the workpiece along a second direction, wherein the control device is further configured to control the transfer mechanism to transfer the workpiece toward a third end of the second direction after cutting the test pattern and configured to control the transfer mechanism to transfer the workpiece toward a fourth end of the second direction opposite the third end when receiving instructions to select continuation of cutting.

6. The cutting apparatus according to claim 1, wherein the control device is further configured to:

receive instructions to select plural patterns to be cut by the cut mechanism;

associate first information identifying the plural patterns selected to be cut by the cut mechanism with second information pertaining to a sequence in which said plural patterns have been selected;

store the first and the second information to a storage device;

judge whether or not each of the patterns identified by the first information stored in the storage device is the test pattern; and determine the cut sequence so that a pattern judged as the test pattern is cut before any normal pattern, and plural normal patterns are cut according to the sequence in which the plural patterns have been selected.

7. The cutting apparatus according to claim 1, wherein the test pattern is smaller than the normal pattern.

8. The cutting apparatus according to claim 1, wherein the control device is further configured to display a message informing that the test pattern is cut by the cut mechanism before the normal pattern is cut by the cut mechanism.

9. A cutting apparatus comprising:

a cut mechanism configured to cut a workpiece; and a control device configured to:

acquire plural patterns including a test pattern used for evaluating a cut quality of the workpiece cut by the cut mechanism and a normal pattern which is not the test pattern; and control the cut mechanism to cut the test pattern before the normal pattern when the normal pattern is acquired before the test pattern.

* * * * *